US011008718B2

(12) United States Patent
Cacho

(10) Patent No.: US 11,008,718 B2
(45) Date of Patent: May 18, 2021

(54) PIVOTABLE TUBULAR PET SCOOP

(71) Applicant: Leonardo C Cacho, Chicago, IL (US)

(72) Inventor: Leonardo C Cacho, Chicago, IL (US)

( * ) Notice: Subject to any disclaimer, the term of this patent is extended or adjusted under 35 U.S.C. 154(b) by 0 days.

(21) Appl. No.: 17/013,049

(22) Filed: Sep. 4, 2020

(65) Prior Publication Data

US 2021/0062444 A1 Mar. 4, 2021

Related U.S. Application Data

(60) Provisional application No. 62/895,913, filed on Sep. 4, 2019.

(51) Int. Cl.
*E01H 1/12* (2006.01)

(52) U.S. Cl.
CPC ... *E01H 1/1206* (2013.01); *E01H 2001/1226* (2013.01)

(58) Field of Classification Search
CPC ..... E01H 1/1206; E01H 2001/1226
See application file for complete search history.

(56) References Cited

U.S. PATENT DOCUMENTS 3,527,492 A * 9/1970 Hollis ..... E01H 1/12 294/115
5,503,442 A * 4/1996 Lee ..... E01H 1/1206 294/1.4
5,577,785 A * 11/1996 Traber ..... B25J 1/04 294/100
2005/0218675 A1* 10/2005 Jung ..... E01H 1/1206 294/1.4
2006/0237978 A1* 10/2006 Krieger ..... E01H 1/1206 294/1.4
2007/0194580 A1* 8/2007 Raasch ..... E01H 1/1206 294/1.4
2012/0292933 A1* 11/2012 Krupp ..... E01H 1/1206 294/1.4

* cited by examiner

*Primary Examiner* — Stephen A Vu
(74) *Attorney, Agent, or Firm* — Charles F. Meroni, Jr.; Meroni & Meroni, P.C.

(57) ABSTRACT

A pivotal tubular pet scoop having a handle connecting to an arm block, a trigger attached to the extension rod, a trigger rod attached to the trigger and moving when the trigger is actuated, the trigger rod passing through the arm block and connecting to a lower arm block, a set of outer springs connected to the arm block and a set of outer springs connected to the lower arm block, both springs connecting to a tubular scoop, the tubular scoop pivotably attached at a connection point to the outer and inner springs and being made of a left jaw and a right jaw, the jaws connected by at least one hinge, such that when the trigger is actuated and the lower arm block is raised relative to the lower arm block, the inner springs are tightened relative to the outer springs thereby causing the left and right jaws to close.

12 Claims, 6 Drawing Sheets

PIVOTABLE TUBULAR PET SCOOP

This application claims the benefit of provisional application No. 62/895,913 filed 4 Sep. 2019.

FIELD OF THE INVENTION

The present invention generally relates to feces disposal, in particular devices for aiding in the sanitary disposal of outdoor pet feces.

BACKGROUND

Fast and trouble-free removal of pet waste from various surfaces lawns is a traditional and confounding problem for owners of dogs, horses, and many other large pets. For many years, since pets have been confined to fenced yards or large outside penned areas, pet owners have had the need for a tool to aid in keeping these areas clean and sanitary, by removing pet waste from moderate to deep grass and other outside surfaces on a regular basis. Often times pet owners will resort to picking up the waste by hand, or hiring expensive outside services to do so. Numerous devices have been conceived with the goal of removing pet waste from yards, large pens and other surfaces, however most of those have either not been effective, were poorly constructed, difficult to use or never proved to be successful in reaching the marketplace.

Despite the various attempts to provide pet owners with solutions, the tools and devices marketed today fall short in solving most of the problems that pet owners are looking to remedy. Problems like; constant bending over to collect the feces, having a tool with two parts requiring both hands to remove the deposits, having to empty the tool with each pickup, or the device can't get through long or thick grass to remove the feces. Other tools are constructed with very poor or weak materials, or have spring loaded or other moving parts, which tend to break and render the tool useless. Such devices include those listed below.

US PGPUB No. 2012/0080894 by Williamson discloses The Doggie Scoop, included with a disposable plastic bag, is a device for the efficient and sanitary collection and disposal of canine fecal matter (dog poop). Before using the Doggie Scoop, insert a disposable plastic bag into Scoop, then, when a dog gets ready to poop, slide the lock on the handle of the Scoop forward with your thumb to open the Scoop (which will be opened horizontally), then slide the extension of the Scoop under the dog to catch the poop. The extension of the Scoop should lie flat against the ground since dogs usually squat close to the ground when they poop. The wheels on the Doggie Scoop help in sliding the Scoop under the dog, and since the wheels can rotate 360 degrees, the Scoop can be moved in any direction to accommodate any movement of the dog. When the dog is finished, slide the Scoop out from under the dog, squeeze the handle on the Scoop to close the Scoop, and with your thumb, slide the lock on the handle of the Scoop backward to lock the Scoop and keep it closed. The poop that collects on the extension will now drop into the storage box. Grasp the pull cords on the enclosed plastic bag to remove the bag with its contents, then dispose of the plastic bag in a garbage can. The Doggie Scoop enables a person to collect the dog poop before it touches the ground and to dispose of the poop in a sanitary manner without having to bend down to pick up the poop or to touch the stuff.

U.S. Pat. No. 9,332,732 by Stoccardo discloses a hands-free method for handling animal waste entails securing a support structure to an animal, preferably a dog. The support structure includes a first latching mechanism which is used to secure a disposable waste receptacle. The disposable waste receptacle is handled via a manipulating tool and corresponding second latching mechanism, with the manipulating tool being operated by means of a user interface. The manipulating tool is used to couple the disposable waste receptacle to the first latching mechanism. After the disposable waste receptacle accumulates excrement, the manipulating tool is used to decouple the disposable waste receptacle from the support structure and discard the disposable waste receptacle in a separate trash receptacle.

U.S. Pat. No. 9,693,533 by Taylor et al, discloses a scooping pan having a rear dumping feature that can be configured to scoop up general refuse, pet refuse, urine clumps, etc. from the ground, a litter box, etc. The scooping pan can optionally include one or more openings or slots that enable litter to pass through the openings or slots when the pet refuse, urine clumps, etc. are removed from the litter box. The rear of the scooping pan includes an openable flap that enables the general refuse, pet refuse, urine clumps, etc. in the scooping pan to be dumped out of the rear of the scooping pan.

U.S. Pat. No. 9,850,632, by Hays discloses, a tool for removing and holding dog excrement from both grass, and other non-grass surfaces, comprised of a pole handle at the upper portion and a set of beveled tines and collection pan on the lower end. The handle is connected at the rear of the collection pan at a an angle which aids in placement of the fork in the best possible position for leverage and moving smoothly beneath the feces. The separated beveled tines allow easy penetration of grass or debris beneath the feces, which is moved over the beveled tines and into the collection pan with a slight tip of the fork. The collection pan is formed with raised front, back and sidewalls, which recess the collection pan to hold the gathered feces. The collection pan is capable of containing considerable feces prior to being emptied into an appropriate trash receptacle.

In addition, many other devices merely make feces pickup more sanitary, rather than increasing the convenience of such tasks. Therefore, there is a significant need for a device that solves the problems of both speed and sanitation.

These problems, and others, have been addressed by the Pivotable Tubular Pet Scoop disclosed herein and discussed in greater detail below.

BRIEF SUMMARY

The pivotal tubular pet scoop of the present disclosure thus has some aspects as discussed herein to fix the above disclosed issues. It may be used for easy and sanitary transportation of waste in to an acceptable plastic bad. The tubular wall form splits open and closes on operation with an handle and hinges to facilitate waste removal.

The present invention may provide several potential advantages over its competitors: 1) Allows a user to quickly and easily remove the bag; 2) Saves time and energy; 3) Eliminates Spillage and Messes; 4) Keeps hands clean without the need of gloves In addition the target market for this includes: 1) Pet Stores; 2) Hardware stores; 3) Websites; 4) Home shopping networks And there are some design features that may set this invention apart from modern day competitors including 1) Tubular Jaws; hinges and or pivoting screws to close/open the Jaws; 3) The jaws having end sides. One having a stud for an extension arm and the other having a bag hook with a bag hook; 4) Being able to accept bags with rubber or elastic open ends for easier installation In a first embodiment the disclosure contemplates a pivotal tubular pet scoop having a handle connected to an extension rod, the extension rod having a bottom, the bottom connecting to an arm block, a trigger attached to the extension rod and located below the handle, a trigger rod attached to the trigger and moving when the trigger is actuated a bottom portion of the trigger rod passing through a hole in the arm block and connecting to a lower arm block, a set of outer springs connected to the arm block and a set of outer springs connected to the lower arm block, both springs connecting to a tubular scoop, the tubular scoop pivotably attached at a connection point to the outer and inner springs and being made of a left jaw and a right jaw, the jaws connected by at least 1 hinge, such that when the trigger is actuated and the lower arm block is raised relative to the lower arm block, the inner springs are tightened relative to the outer springs thereby causing the left and right jaws to close and form a tube, and a bag attachment located on the tubular scoop for attaching disposable bags.

In another embodiment the disclosure contemplates a method for disposing of pet feces including the steps of providing pet feces, providing a pivotal tubular pet scoop, the pet scoop comprising a handle connected to an extension rod, the extension rod having a bottom, the bottom connecting to an arm block; a trigger attached to the extension rod and located below the handle; a trigger rod attached to the trigger and moving when the trigger is actuated a bottom portion of the trigger rod passing through a hole in the arm block and connecting to a lower arm block; a set of outer springs connected to the arm block and a set of outer springs connected to the lower arm block, both springs connecting to a tubular scoop; the tubular scoop pivotably attached at a connection point to the outer and inner springs and being made of a left jaw and a right jaw, the jaws connected by at least 1 hinge, such that when the trigger is actuated and the lower arm block is raised relative to the lower arm block, the inner springs are tightened relative to the outer springs thereby causing the left and right jaws to close and form a tube; and a bag attachment located on the tubular scoop for attaching disposable bags, attaching a bag to the pet scoop with the bag attachment, positioning the pet scoop such that the feces is located between the left and right jaws of the pet scoop, actuating the trigger to close the left and right jaws of the pet scoop, lifting the pet scoop causing the tubular scoop to pivot thereby causing the feces to fall into the bag, and removing the bag thereby disposing of the pet feces.

Such embodiments do not represent the full scope of the invention. Reference is made therefore to the claims herein for interpreting the full scope of the invention. Other objects of the present invention, as well as particular features, elements, and advantages thereof, will be elucidated or become apparent from, the following description and the accompanying drawing figures.

DESCRIPTION OF THE DRAWINGS

The present invention may be better understood, and its numerous objects, features, and advantages made apparent to those skilled in the art by referencing the accompanying drawings.

DETAILED DESCRIPTION

Figure 1:
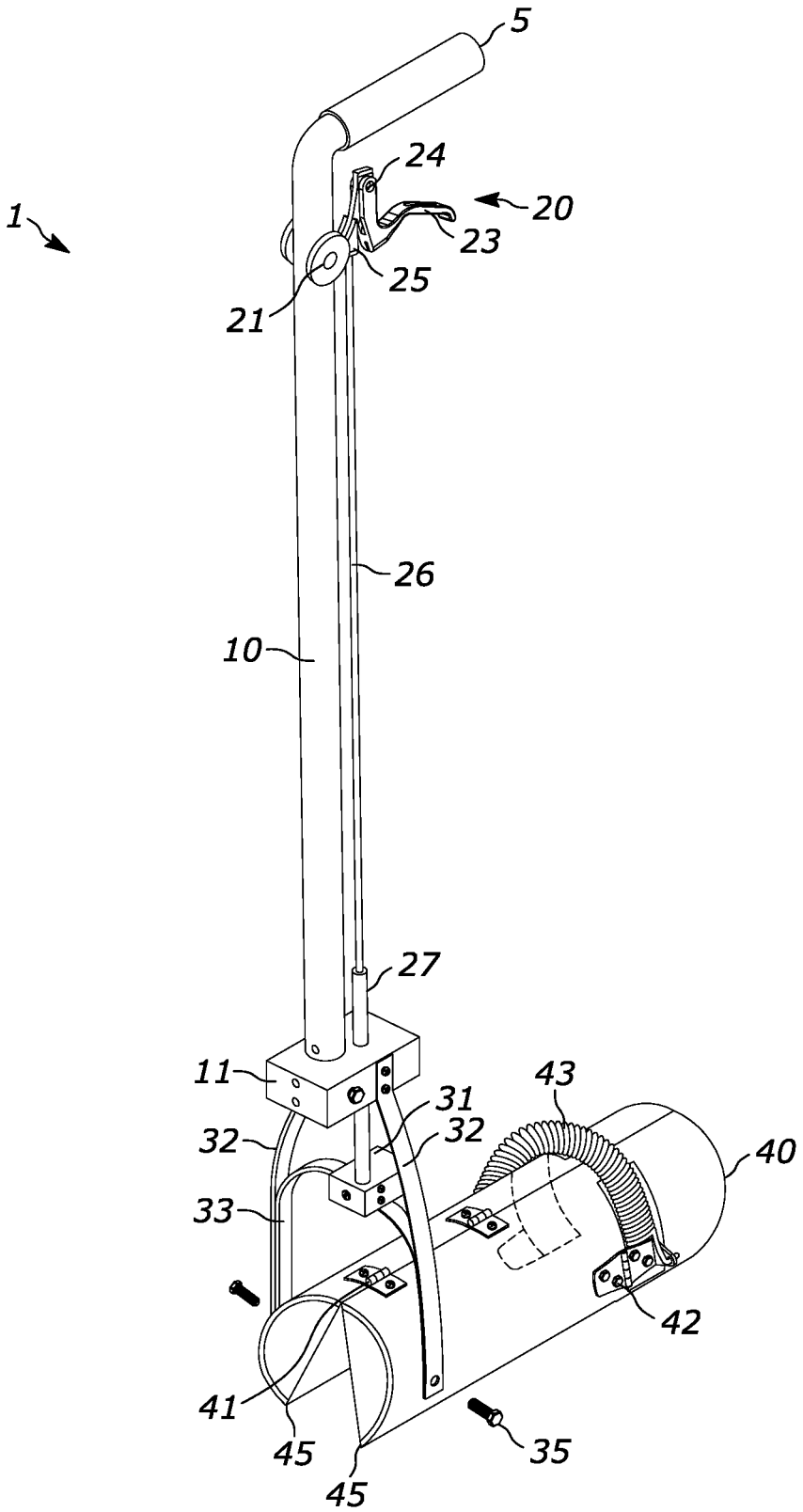
FIG. 1 is a perspective view of a pivotable tubular pet scoop according to the present disclosure.
Figure 2:
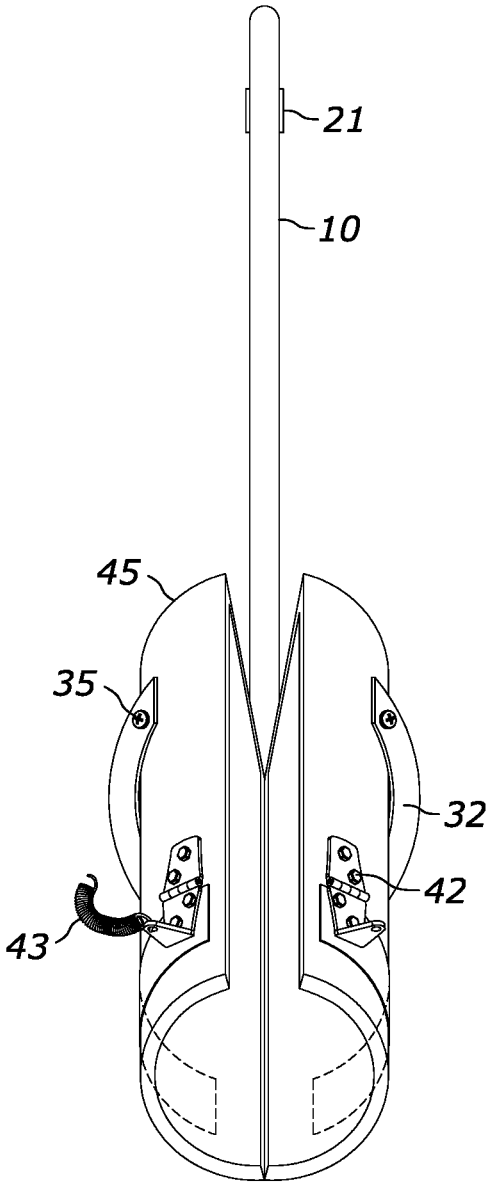
FIG. 2 is a view of a tube portion of a pivotable tubular pet scoop in an open position according to the present disclosure.

Referring now the drawings with more specificity, the present invention essentially discloses a device for picking up and throwing away feces, in particular a pivotal tubular pet scoop. The preferred embodiments of the present invention will now be described with reference to FIGS. 1-6 of the drawings. Variations and embodiments contained herein will become apparent in light of the following descriptions.

Looking now to FIGS. 1-6 pivotable tubular pet scoop 1 is disclosed in greater detail. The pet scoop 1 may preferably include a handle 5 attached to an extension frame 10. The extension rod 10 extends away from the handle to give the user extended reach. Attached to rod 10 is a trigger 20 and block 11. Trigger 20 may be flat or may have a handle portion 23 and an angled portion 24, depending on the user and manufacturer's ergonomic choices. Handle 20 is attached to rod 10 at attachment point 21, which may be affixed with a lock nut and screw 2 or another attachment that allows the trigger 20 to swing from rod 10 with respect to handle 5. Attachment point 21 may also be loaded with a spring to provide tension to trigger 20.

Trigger 20 is operationally connected to trigger rod 26 which moves when the trigger is pulled/released. In particular it moves relative to frame 10. At the bottom of trigger rod 26, there may be lower arm block shaft 27 which may have a different diameter than trigger rod 26. Shaft 27 passes through a hold in block 11 to move lower block 31 which moves with relation to block 11. connected to block 11 are outer springs 32 and connected to lower block 32 are inner springs 33. Both springs 32 and springs 33 are connected to tubular scoop 40. This attachment may be made by screw 35 at attachment point 35.

Figure 3:
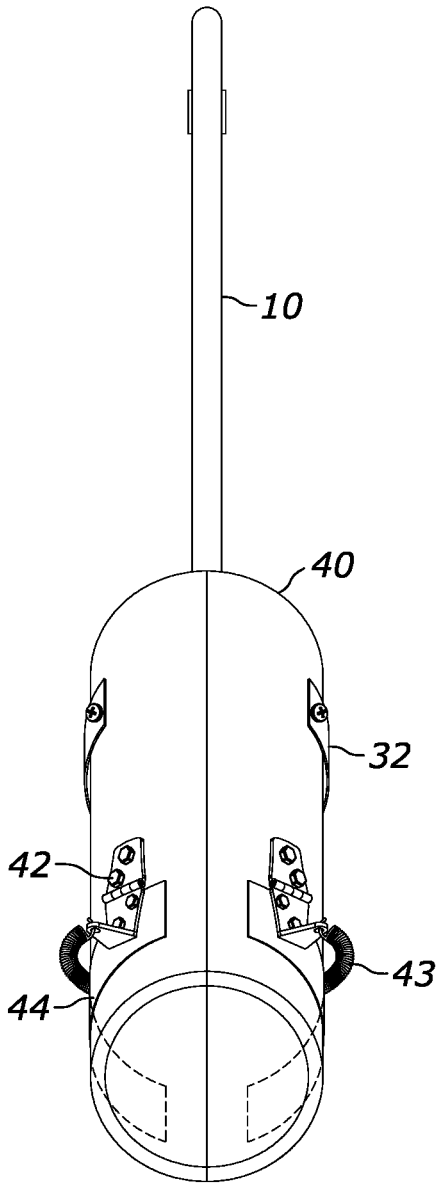
FIG. 3 is a view of a tube portion of a pivotable tubular pet scoop in a closed position according to the present disclosure.

Hinges 41 connect the left and right sides 45 of tubular scoop 40. As a result, when rod 26 causes block 31 to move in relation to block 11 springs 33 are tightened relative to springs 32 causing sides 45 to close (as shown in FIG. 3). In addition, scoop 40 may have a bag attachment 43, which may be a spring or other adjustable mechanism. This may also include a strap 44 for more securely connecting an attachment. This is connected at connecting points 42, which may be strap hinges, or another implement.

Figure 4:
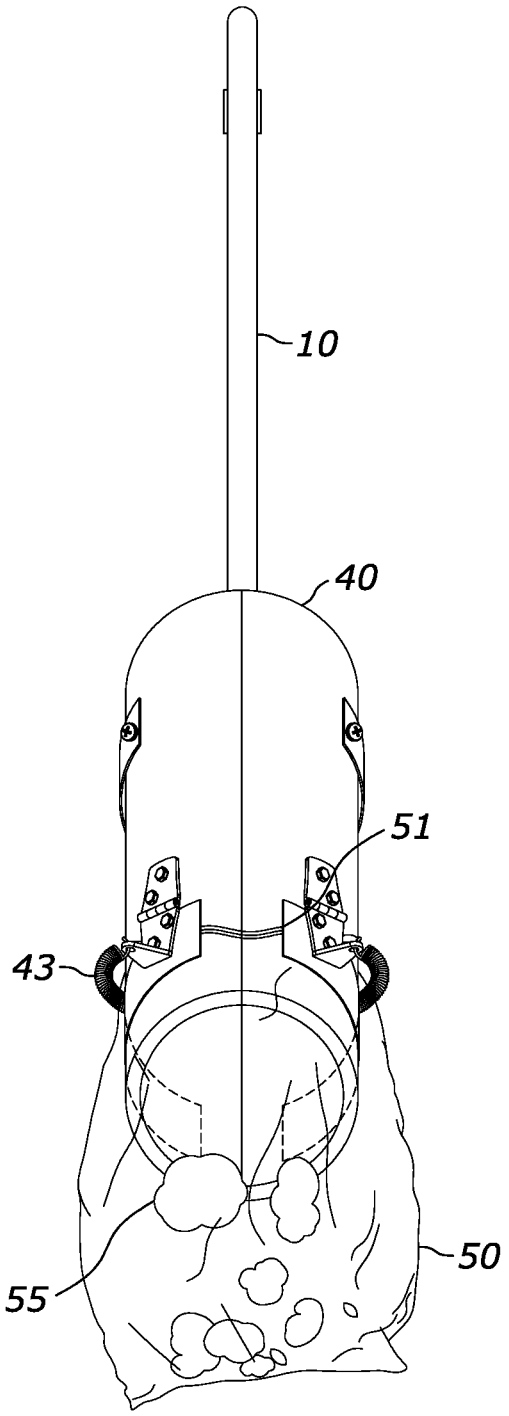
FIG. 4 is a view of a tube portion of a pivotable tubular pet scoop in a closed position with bag attachment according to the present disclosure.
Figure 5:
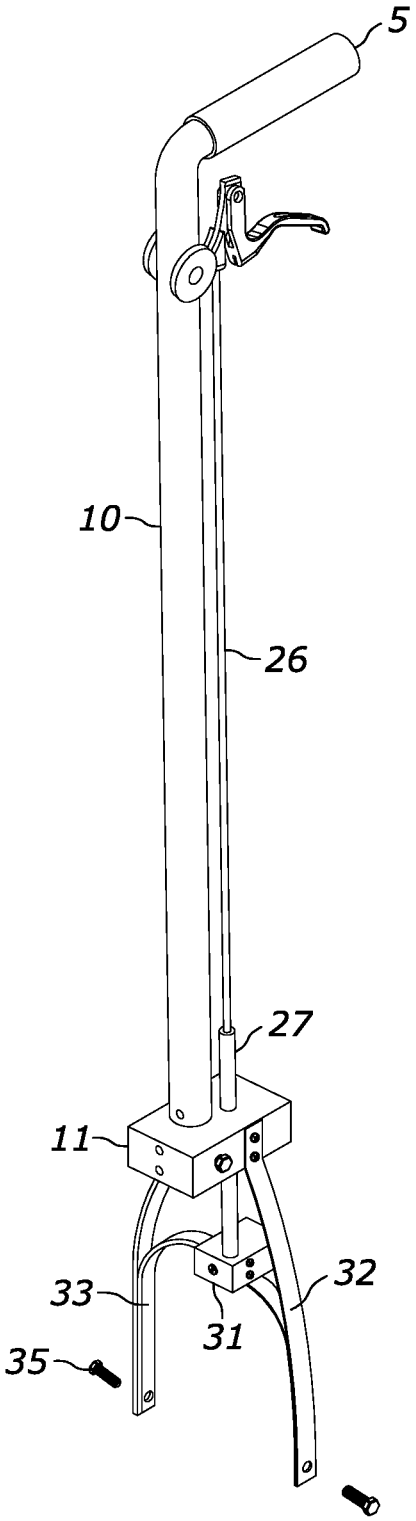
FIG. 5 is a perspective view of a handle portion of a pivotable tubular pet scoop according to the present disclosure.
Figure 6:
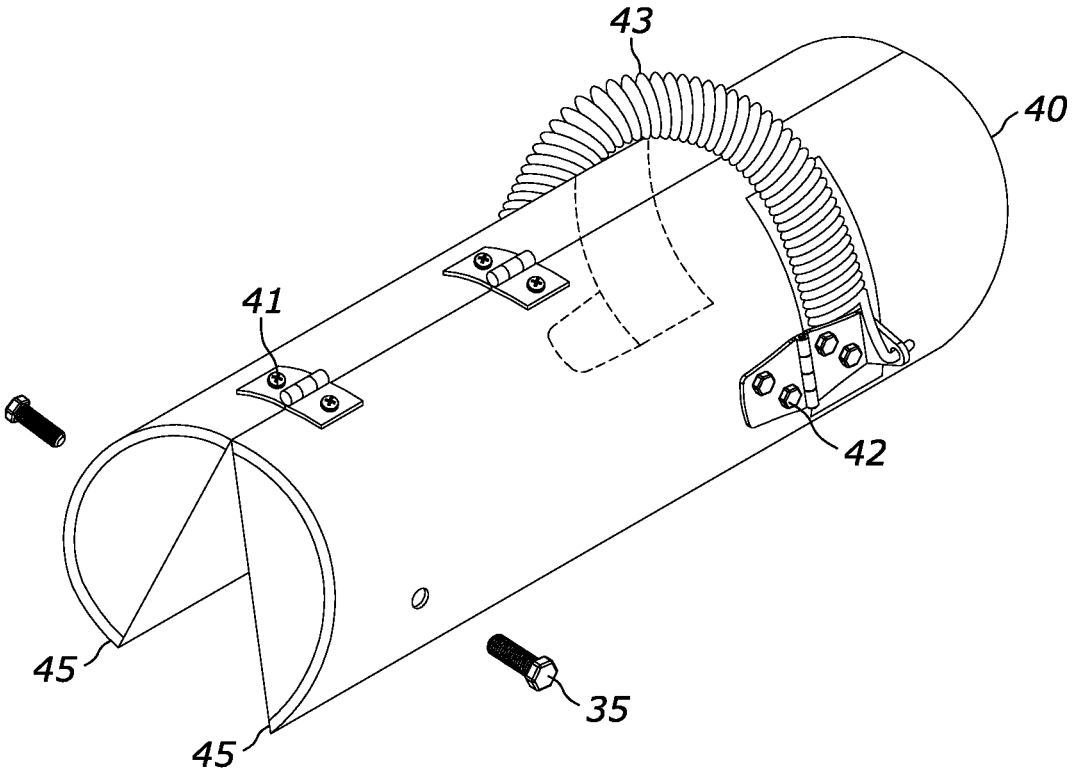
FIG. 6 is a partially exploded view of a tube portion of a pivotable tubular pet scoop in an open position according to the present disclosure

Tubular scoop 40 is pivotable around point 35. This allows the far side to fall relative to the connected side. As shown in FIG. 4, this means that if a bag 50 is attached to tubular scoop 40 by bag attachment 43 feces 55 that have been picked up by the closing of sides 45 will fall into bag 50. Bag edge 51 is also shown to illustrate how it may be connected to tubular scoop 40.

Such illustrations are illustrative in nature and do not encompass all of the possible angles and types of components utilized in feces removal devices according to this disclosure.

INDUSTRIAL APPLICABILITY

While other competitors to the pivotable tubular pet scoop 1 exist, the present disclosure contemplates specific design features, for some embodiments, that set this invention apart from modern day competitors. These may preferably include, the tubular jaws 45 measuring nine inches long and three inches in diameter; two hinges 41 with a pivoting screw to close/open the jaws 45; both jaws 45 having two end sides, one having a stud 35 for an extension arm 10 and the other having a bag catch 43, 44 for connecting to a bag 50 such as a plastic bag. The scoop 1 is able to accept bags 50 with rubber or elastic open ends 51 for easier installation. The scoop 1 can be made with metallic or plastic parts, in at least on embodiment the extension arm is metallic and the jaws 45 are made with plastic such as PVC.

As this unique design for a pet scoop enables new and more sanitary methods removing pet waste the disclosure also contemplates methods for operation of the disclosed invention. In one embodiment such a method for operating tubular scoop 1 includes: installing replaceable bags 50 onto the open end of the scoop 40; dropping both jaws 45 into the middle of an object 55; pulling the trigger 20, thereby moving rod 26 to close the jaws 45; lifting the arm 10 thereby tilting the scoop 40 causing the object 55 to fall into the replaceable bag 50; and then removing the bag 50 from the scoop 40.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. A pivotal tubular pet scoop comprising:

a handle connected to an extension rod, the extension rod having a bottom, the bottom connecting to an arm block;

a trigger attached to the extension rod and located below the handle;

a trigger rod attached to the trigger and moving when the trigger is actuated a bottom portion of the trigger rod passing through a hole in the arm block and connecting to a lower arm block;

a set of outer springs connected to the arm block and a set of inner springs connected to the lower arm block, both springs connecting to a tubular scoop;

the tubular scoop pivotably attached at a connection point to the outer and inner springs and being made of a left jaw and a right jaw, the jaws connected by at least 1 hinge, such that when the trigger is actuated and the lower arm block is raised relative to the lower arm block, the inner springs are tightened relative to the outer springs thereby causing the left and right jaws to close and form a tube;

a bag attachment located on the tubular scoop for attaching disposable bags; wherein the connection point is located on a first end of the tubular scoop, and the bag attachment is located on a second end of the tubular scoop; and the pivotable connection point connecting the tubular scoop to the outer and inner springs is a screw.

2. The pivotable tubular pet scoop of claim 1 wherein:

the bag attachment is a spring.

3. The pivotable tubular pet scoop of claim 1 wherein:

the bag attachment is a band.

4. The pivotable tubular pet scoop of claim 1 wherein:

the bag attachment is a combination band and spring.

5. The pivotable tubular pet scoop of claim 1 wherein:

the scoop measures at least nine inches long and three inches in diameter.

6. The pivotable tubular pet scoop of claim 1 wherein:

the trigger rod, has a lower arm block shaft which is a different diameter than the trigger rod, the lower arm block shaft being the portion that connects to the lower arm block and passes through the arm block.

7. The pivotable tubular pet scoop of claim 1 further comprising:

a disposable bag attached to the pet scoop by the bag attachment.

8. A method for disposing of pet feces comprising:

locating pet feces;

providing a pivotal tubular pet scoop, the pet scoop comprising a handle connected to an extension rod, the extension rod having a bottom, the bottom connecting to an arm block; a trigger attached to the extension rod and located below the handle; a trigger rod attached to the trigger and moving when the trigger is actuated a bottom portion of the trigger rod passing through a hole in the arm block and connecting to a lower arm block; a set of outer springs connected to the arm block and a set of inner springs connected to the lower arm block, both springs connecting to a tubular scoop; the tubular scoop pivotably attached at a connection point to the outer and inner springs and being made of a left jaw and a right jaw, the jaws connected by at least 1 hinge, such that when the trigger is actuated and the lower arm block is raised relative to the lower arm block, the inner springs are tightened relative to the outer springs, thereby causing the left and right jaws to close and form a tube; the pivotable connection point connecting the tubular scoop to the outer and inner springs is a screw; and a bag attachment located on the tubular scoop for attaching disposable bags; and the connection point is located on a first end of the tubular scoop, and the bag attachment is located on a second end of the tubular scoop;

attaching a bag to the pet scoop with the bag attachment;

positioning the pet scoop such that the feces is located between the left and right jaws of the pet scoop;

actuating the trigger to close the left and right jaws of the pet scoop;

lifting the pet scoop causing the tubular scoop to pivot thereby causing the feces to fall into the bag; and removing the bag thereby disposing of the pet feces.

9. The method of claim 8 wherein:

the bag attachment is a spring.

10. The method of claim 8 wherein:

the bag attachment is a band.

11. The method of claim 8 wherein:

the bag attachment is a combination band and spring.

12. The method of claim 8 further comprising:

causing more than one feces to fall into the bag prior to removing the bag, thereby disposing of more than one feces using a single bag.

* * * * *